United States Patent [19]

Lanik et al.

[11] 4,376,651

[45] Mar. 15, 1983

[54] PROTECTIVE COATING FOR FOUNDRY IMPLEMENTS WHICH CONTACT MOLTEN ALUMINUM ALLOYS

[75] Inventors: Igor Lanik, Boskovice; Otakar Havelka, Blansko; Dusan Pirochta, Brno, all of Czechoslovakia

[73] Assignee: Vyzkumny ustav keramiky, Pilsen, Czechoslovakia

[21] Appl. No.: 347,917

[22] Filed: Feb. 11, 1982

[30] Foreign Application Priority Data

Feb. 17, 1981 [CS] Czechoslovakia ..... 1107-81

[51] Int. Cl.[3] ..... B28B 7/36

[52] U.S. Cl. ..... 106/38.24; 106/38.25; 106/38.28; 106/269; 106/278; 106/281 R; 427/135

[58] Field of Search ..... 106/38.24, 38.25, 38.28, 106/269, 278, 281 R; 427/135, 133

[56] References Cited

U.S. PATENT DOCUMENTS 2,956,890 10/1960 Casteras ..... 106/38.28

3,415,669 12/1968 Elste ..... 106/38.25

*Primary Examiner*—Lorenzo B. Hayes

*Attorney, Agent, or Firm*—Burgess, Ryan and Wayne

[57] ABSTRACT

The invention relates to a protective coating for foundry implements which are in contact particularly with molten aluminium alloys, comprising from 10 to 60 weight parts of extraction oil obtained by deasphalting and dewaxing heavy oils left after the vacuum distillation of crude oil having a kinematic viscosity of from 37 to 53 $mm^2.sec.^{-1}$ at 100° C. and an open cup flash point of at least 285° C.; further from 5 to 30 weight parts of a mixture of light and middle oils obtained by the vacuum distillation of crude oils having a flash point of at least 150° C. and a viscosity of from 16 to 22 $mm^2.sec.^{-1}$ at 50° C., from one to 15 weight parts of graphite, or from 0.1 to 5 weight parts of wool fat, and from 0.1 to 3 weight parts of ethoxylated fatty alcohols having from 12 to 18 carbon atoms and from 10 to 20 ethylene oxide units in the molecule, the coating being characterized in that it additionally contains from 20 to 65 weight parts of titanium dioxide.

1 Claim, No Drawings

PROTECTIVE COATING FOR FOUNDRY IMPLEMENTS WHICH CONTACT MOLTEN ALUMINUM ALLOYS

The invention relates to a protective coating for foundry implements which are contacted with a molten aluminum alloy, comprising from 10 to 60 weight parts of extraction oil obtained by deasphalting and dewaxing heavy oils left after the vacuum distillation of crude oil having a kinematic viscosity of from 37 to 53 $mm^2.sec.^{-1}$ at 100° C. and an open cup flash point of at least 285° C., further from 5 to 30 weight parts of a mixture of light and middle oils obtained by the vacuum distillation of crude oil having a flash point of at least 150° C. and a viscosity of from 16 to 22 $mm^2.sec.^{-1}$ at 50° C., from 1 to 15 weight parts of graphite, or from 0.1 to 5 weight parts of wool fat, and from 0.1 to 3 weight parts of ethoxylated fatty alcohols having from 12 to 18 carbon atoms and from 10 to 20 ethylene oxide units in the molecule.

Foundry implements which, in operation, are brought into contact with molten aluminum alloys such as ladles for scooping molten metal, are usually made of steel sheet, or cast from grey cast iron. Due to a thermochemical reaction of aluminum alloys, they are attacked so that their lifetime is very short.

Another disadvantage consists in that their surface is wetted when in contact with molten aluminum so that especially slag and oxide films adhere thereto and impair the functional ability of such implements. In practice, such foundry implements are provided with a protective coating which prevents them from being both eroded and corroded. In addition, the protective coating should not be wetted if exposed to the molten aluminum.

Known protective coatings for molten metal scooping ladles and like implements are based upon kaolin, floated whiting, water and, optionally, other substances. There is known a dispersion of 3 weight parts of floated whiting, one weight part of sodium silicate, 15 weight parts of water and 2 weight parts of graphite. Another known aqueous dispersion comprises floated whiting, iron sesquioxide together with an additive of 6% by weight of water glass. Another known composition consists of an aqueous dispersion of kaolin with an additive of water glass. Still another protective coating comprises a dispersion of one volume part of pulverized graphite in 15 volume parts of 30 percent aqueous water glass solution.

Although all of the well-known protective coatings possess certain merits, many problems and drawbacks are encountered in their use. For example, their lifetime is relatively short; after several casting steps, such coatings, when exposed to varying heat stresses, tend to peel off and have to be renewed. Further, they cannot be applied arbitrarily to both cool and hot surfaces. Apart from this, their wetting power, especially with graphite containing coatings, gradually increases.

It is therefore an object of the present invention to eliminate or at least minimize the disadvantages of the prior art compositions and to provide an improved protective coating for foundry implements which are in contact with molten aluminum alloys, said coating comprising from 10 to 60 weight parts of extraction oil obtained by deasphalting and dewaxing heavy oils left after the vacuum distillation of crude oil having a kinematic viscosity of from 37 to 53 $mm^2.sec.^{-1}$ at 100° C.

and an open cup flash point of at least 285° C.; further, from 5 to 30 weight parts of a mixture of light and middle oils obtained by the vacuum distillation of crude oil having a flash point of at least 150° C. and a viscosity of from 16 to 22 $mm^2.sec.^{-1}$ at 50° C., from one to 15 weight parts of graphite, or from 0.1 to 5 weight parts of wool fat, and from 0.1 to 3 weight parts of ethoxylated fatty alcohols having from 12 to 18 carbon atoms and from 10 to 20 ethylene oxide units in the molecule.

In accordance with a feature of the invention, the coating additionally contains from 20 to 65 weight parts of titanium dioxide.

One advantage of the protective coating according to the invention is that it can be easily applied to both cool and hot surfaces of work implements. Once burned out in molten aluminum, the coating creates a protective film which has a multiple lifetime when compared with that of well-known coatings. The unwettable character of the coating, when contacted with molten aluminum, or slag, remains constant during the entire function period of the tool. If mechanically damaged, the coating can be easily repaired.

Apart from this, the coating of the invention exhibits very good effects which protect the implement against mechanical erosion and thermochemical corrosion caused by the aluminum alloy melt and its slag.

The following examples are given as illustrative, without, however, limiting the scope of the invention.

EXAMPLE 1

In a vessel provided with an agitator, there were successively put 50 weight parts of a cylinder oil having a kinematic viscosity of from 37 to 53 $mm^2.sec.^{-1}$ at 100° C. and an open cup flash point of 285° C., 20 weight parts of a mixture of light and middle mineral oils obtained by distillation of crude oil having a flash point of at least 150° C. and a viscosity within the range of from 16 to 22 $mm^2.sec.^{-1}$ at 50° C., 3 weight parts of finely ground and pasted graphite, 2 weight parts of wool fat, 22 weight parts of titanium dioxide and 2 weight parts of ethyoxylated fatty alcohols containing 12 to 18 carbon atoms and from 10 to 18 ethylene oxide units in the molecule. After the mixture was thoroughly homogenized and dispersed, the composition was ready to use.

EXAMPLE 2

In a vessel equipped with stirring means, there was homogenized a mixture containing 40 weight parts of an extraction oil obtained by deasphalting and dewaxing heavy oils left after vacuum distillation of crude oil, and 7 weight parts of a mixture of light and middle mineral oils obtained by distillation of crude oil having a flash point of at least 150° C. and a viscosity within the range of from 16 to 22 $mm^2.sec.^{-1}$ at 50° C. In the thus prepared composition, there were successively intermixed under intensive agitation, 2 weight parts of finely ground colloidal graphite, 0.2 weight parts of ethoxylated fatty alcohols containing from 12 to 18 carbon atoms and from 10 to 20 ethylene oxide units in the molecule, 0.3 weight parts of wool fat and 43 weight parts of titanium dioxide. After a thorough homogenization, the product was ready to use.

EXAMPLE 3

In a vessel with an agitator, there were successively put, under intensive agitation, 20 weight parts of a mixture of light and middle oils obtained by distillation of crude oil having a flash point of at least 150° C. and a viscosity within the range of from 16 to 22 $mm^2.sec.^{-1}$ at 50° C., 16 weight parts of a cylinder oil havving a kinematic viscosity of from 37 to 53 $mm^2.sec.^{-1}$ at 100° C., 13 weight parts of finely ground and pasted graphite and 60 weight parts of finely ground titanium dioxide. After a thorough homogenization, the product was ready to use.

The composition as described in Example 1 was applied as a protective coating to the tube of a dipping pyrometer installed in a holding furnace for molten aluminum alloys. The tube was in permanent contact with molten metal and, after a level drop, also with its slag. The composition was applied to the tube manually by means of a brush. After the tube had been dipped in the molten metal, hydrocarbon components of the coating burned out and a white homogeneous protective film remained thereon. The coating proved to be unwettable if exposed to molten metal and slag, and its lifetime was about quadruple that ascertained with conventional products of this type. Such a protective coating is particularly suitable to be used for implements of a static character.

The composition according to Example 2 was employed as a protective coating for a cast iron ladle for supplying molten aluminum to an automatic metal dosing device of a pressure die casting plant. In operation, the ladle is dipped in molten metal in the casting plant, scoops of a metered volume of metal and poured in the filling cylinder of the plant. In such a process, the ladle is successively exposed to the effects of slag, molten aluminum as well as to the one-side and finally both-sided air cooling. The coating was applied manually by brush. A white film left on the ladle after the hydrocarbon components had burned out, was homogeneous, unwettable when contacted with molten aluminium and slag, and very resistant to both mechanical and thermal stresses. It remained compact after many technological cycles and did not tend to peel off and crack. Its lifetime was about quadruple that of conventional products of the kind. Such a composition can be also used for hot repairing damaged protective coatings. It is particularly suitable for thick-walled implements with a reduced thermal shape deformability.

The composition according to Example 3 was used as a protective coating for a manual molten metal scooping ladle made of metal sheet. The stress value was similar to that described in Example 2, and also the results were analogous. The product is particularly suitable to be used for thin-walled tools showing marked thermal expansion.

We claim:

1. A protective coating for foundry implements which are in contact with molten aluminium alloys, comprising from 10 to 60 weight parts of extraction oil obtained by deasphalting and dewaxing heavy oils left after the vacuum distillation of crude oil having a kinematic viscosity of from 37 to 53 $mm^2.sec.^{-1}$ at 100° C. and an open cup flash point of at least 285° C.; from 5 to 30 weight parts of a mixture of light and middle oils obtained by the vacuum distillation of crude oils having a flash point of at least 150° C. and a viscosity of from 16 to 22 $mm^2.sec.^{-1}$ at 50° C.; from 1 to 15 weight parts of graphite, or from 0.1 to 5 weight parts of wool fat, and from 0.1 to 3 weight parts of ethoxylated fatty alcohols having from 12 to 18 carbon atoms and from 10 to 20 ethylene oxide units in the molecule and from 20 to 65 weight parts of titanium dioxide.

* * * * *